United States Patent [19]

Taylor

[11] 4,034,534

[45] July 12, 1977

[54] LOUVERED CEILING

[75] Inventor: John Ludlum Taylor, Jagerslaan, Netherlands

[73] Assignee: Intalite International, Willemstaad, Netherlands

[21] Appl. No.: 649,724

[22] Filed: Jan. 16, 1976

Related U.S. Application Data

[63] Continuation-in-part of Ser. No. 462,423, April 19, 1974, abandoned.

[30] Foreign Application Priority Data

Apr. 30, 1973 Canada ..... 169893

[51] Int. Cl.[2] ..... E04C 2/42

[52] U.S. Cl. ..... 52/668; 403/347

[58] Field of Search ..... 52/664–668, 52/484, 486, 758 A, 507, 581, 660, 28; 403/347; 98/114

[56] References Cited

U.S. PATENT DOCUMENTS

| | | | |
|---|---|---|---|
| 2,689,026 | 9/1954 | Zingone | 52/507 |
| 2,706,314 | 4/1955 | Siering | 52/664 |
| 2,857,631 | 10/1958 | Zingone | 52/668 |
| 2,905,286 | 9/1959 | Adams et al. | 52/667 |
| 3,023,861 | 3/1962 | Bak | 52/667 |
| 3,190,208 | 6/1965 | Styne et al. | 52/664 |
| 3,310,922 | 3/1967 | Hoffmann | 52/664 |
| 3,321,882 | 5/1967 | Stahlhut | 52/758 A |
| 3,797,192 | 3/1974 | DeJonge | 52/665 |

*Primary Examiner*—Price C. Faw, Jr.
*Assistant Examiner*—James L. Ridgill, Jr.
*Attorney, Agent, or Firm*—Berman, Aisenberg & Platt

[57] ABSTRACT

A light transmitting false ceiling made up of louvers and supporting runners, the latter being adapted to be suspended from a normal ceiling with lamps mounted above the false ceiling. The louvers have extensions at opposite edges for engagement with and support by the adjacent runners. The louvers are made up of intersecting members defining open cells therebetween. Each of the louver members as well as each of the runners is of upwardly open channel section. The runners have downwardly extending slots in their upstanding walls to receive hook-shaped extensions on the louver members, and these slots are wider at the top than at the bottom to facilitate installation on site. The widened runner slots on one wall of each runner are offset from those on the opposed wall by the width of the louver channel members. The hooked-shaped extensions on the members protrude into the channels of the runners and together with the bottom and upstanding walls of the runners block light leaks through the widened runner slots so that light is transmitted uniformly through the false ceiling to yield the appearance of a single large louver with no apparent seams.

7 Claims, 6 Drawing Figures

LOUVERED CEILING

This invention is a Continuation-in-Part of my copending application, Ser. No. 462,423, filed Apr. 19, 1974 now abandoned.

BACKGROUND OF THE INVENTION

This invention relates to louvered ceilings, that is to say it relates to false ceilings made up of louvers and runners which support the louvers and are attached to the normal ceiling so as to be suspended therebelow, the louvers being in the form of intersecting slats forming open cells therebetween, through which cells light may pass from light sources above the louvers.

Louvered ceilings are becoming increasingly popular but with bigger cell sizes, necessitating thicker slats, the cost becomes prohibitive. Moreover, the use of high-temper material such as high-temper aluminum alloy for the runners to give them the necessary strength to support the louvers prevents them from being pre-painted at the same time as the louvers, since the temperatures employed in baking the paint on to the louvers would reduce the high-temper of the runners. Separate painting of the runners, of course, renders it difficult to match the finish on the runner exactly to the finish on the louvers and this is obviously undesirable.

Further disadvantages of conventional louvered ceilings are that they are bulky, expensive and difficult to transport to their installation sites when assembled at their points of fabrication and their construction does not lend itself to complete assembly at the installation site. Also they are so contructed as to permit light leakage, including bright spots from leakage and reflection, which detract from overall uniformity of indirect lighting which the luminous ceiling seeks to achieve.

It is an object of the present invention to obviate or, at least, mitigate the above disadvantages.

SUMMARY OF THE INVENTION

According to the invention, the louvers, and preferably also the runners, are made from members which have two upstanding longitudinally extending walls joined at their lower edges either directly or by a longitudinally extending base section, each member being made of lighter gauge material than a solid slat of the same strength, while presenting a solid appearance when viewed from below.

By making the runners of channel or like section, they need not be high-tempered and hence may be subjected to a pre-painting treatment at the same time as the louvers, ensuring a perfect match.

By providing downwardly extending slots in the upper edges of the opposing limbs of the runner and providing the projecting parts of opposite edges of the louvers with hook-like extensions or the equivalent, a very simple yet rugged assembly of the ceiling is possible. Moreover, the channel or like section construction of such projecting parts gives them increased resistance to lateral bending which could result in an unpleasing distortion of the cells at the edges of the louvers, causing light leaks, and render difficult the aligning of the projecting parts with the appropriate locations on the runners.

The louvers can be produced in regular square or rectangular shape, and hence an over-lay sheet of plastics or the like may be made in the same simple shape.

Such over-lay sheets may be desirable for diffusing light or for sound treatment.

The louvers being formed of channel-shaped members provided with cooperating and interlocking slot arrangements enable the louvers like the runners, to be easily and conveniently transported as strips to the installation site where they may be quickly assembled by snapping the members together in intersecting relation to lock them in their assembled louvered form.

By widening the tops of the runner slots, the assembled louvers may be easily and quickly engaged on the runners by dropping the hook-like extensions of the louver members in the widened slots, thus facilitating the assembly of the louvers with the runners.

Normally such widening of slots would result in "leaking" of light, i.e., instead of the light being reflected from the panel sides it would pass through the widened slot gaps between the hook-shaped extensions of the louver members and the edges of the slots to cause bright spots detracting from the overall uniformity of light passing through the ceiling. This leaking is prevented in the invention by a unique arrangement of the taper slots such that the tapered sides of the slots are arranged within the channels of the louver members and runners so that light from above passing through the widened portions of the slots is trapped within said channels and does not pass through the ceiling to cause "light leaks."

It is therefore apparent that a prime object of the invention is to provide a luminous ceiling structure which overcomes the above briefly described defects and disadvantages of conventional louvered ceiling structures.

It is another important object of the invention to provide a luminous ceiling structure which is lightweight and inexpensive to fabricate, and which may be transported to an installation site in strip form where it may be easily and quickly assembled.

It is a further object of the invention to provide a luminous ceiling structure having the appearance of a single large louver with no apparent seams, and having a pleasing uniform appearance of indirect lighting, free of "light leaks" and light streaks, despite the widening and tapering of connection slots at the intersections of the runners and louver members, which widening greatly facilitates the assembly of the louvers on the runners.

The attainment of the above objects and advantages has materially contributed to the considerable commercial success of the invention product experienced in the relative short period since start of marketing.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of a specific embodiment when read in connection with the accompanying drawings, wherein like reference characters indicate like parts throughout the several Figures, and in which:

DESCRIPTION OF THE PREFERRED EMBODIMENT

Figure 1:
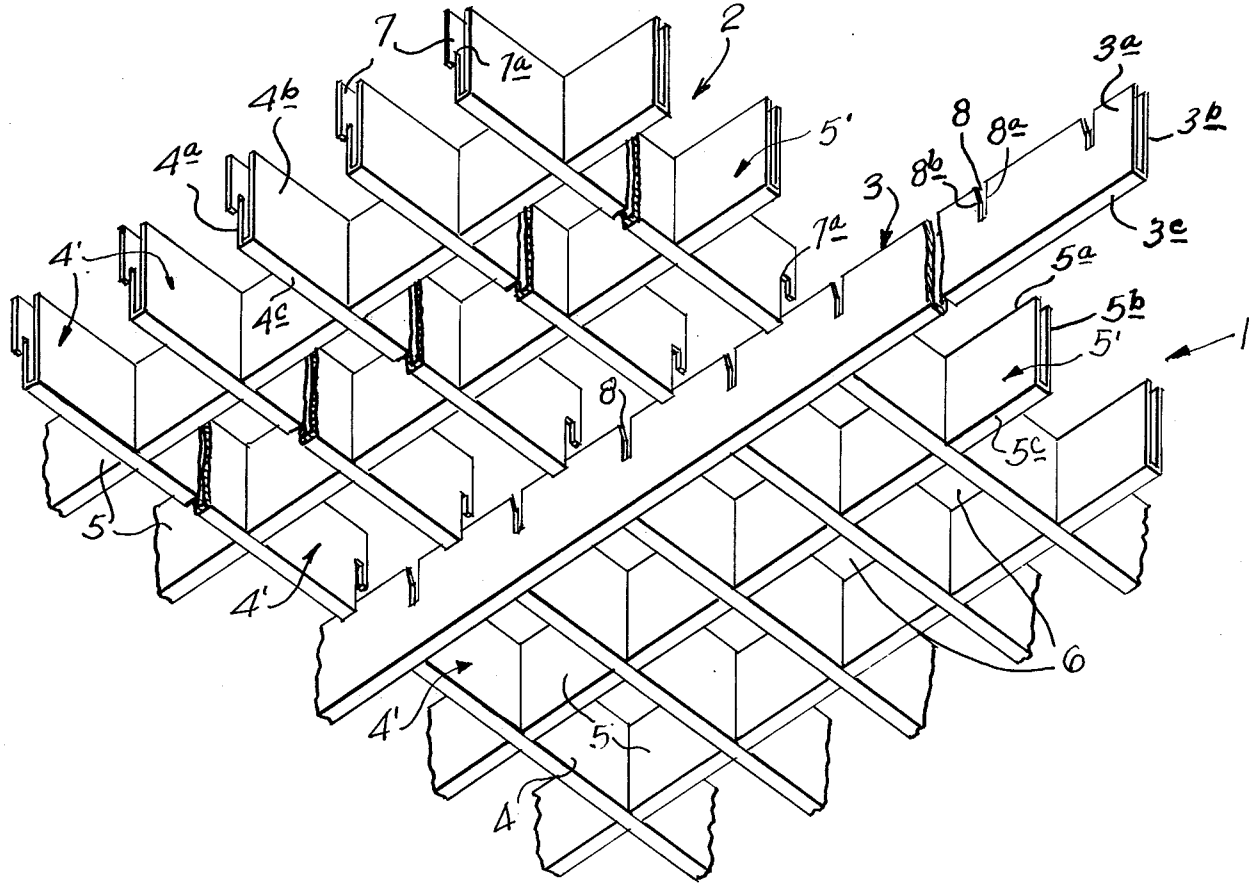
FIG. 1 shows a perspective view from below of a part of a louvered ceiling in partly exploded condition.

FIG. 1 shows two adjacent louvers, or louver panels 1 and 2 and a runner 3 which serves to support the adjacent edges of the louvers. The runner, of course, will be provided with means for suspending it from a normal ceiling. Such means, which may take the form of spaced wires or the like, are not shown in the drawing since they are well known and form no part of the present invention.

Each of the louvers 1 and 2 is made up of intersecting members 4 and 5, which are perpendicular to each other and form open cells 6 therebetween. As shown in the drawing, each member 4 and 5 and the runner 3 are of channel section, the runner having upstanding, opposed walls 3*a* and 3*b* and a base 3*c*, each member 4 having similar opposed walls 4*a*, 4*b* and base 4*c* and each member 5 having like opposed walls 5*a*, 5*b* and base 5*c*. It will be realized, of course, that alternative shapes could be used instead of channel shape, e.g. a U-shape or a V-shape.

The projecting parts 4' of members 4, which are adapted to engage the runner, are of a length equal to a cell width and the projecting parts 5' of members 5, which are at one end only of the louver and are adapted to abut an adjacent louver or panel, are equal in length to a cell width, so that an assembled ceiling will give the appearance of one large louver rather than a plurality of separate louver panels and runners. Of course, instead of having projecting parts 5' at one end only of the louver, there may be projecting parts at both ends, each member 5 having a half cell width projecting part, so that the projecting parts on one louver abut the projecting parts of adjacent louvers, or, in another arrangement, each member 5 having a full cell width projecting part at one end only, adjacent members having their projecting parts at opposite ends of the louver so that the projecting parts of one louver abut the end member 4 of an adjacent louver between the projecting parts of that adjacent louver, the projecting parts of adjacent louvers thus being interleaved.

Each projecting part 4' is provided at the end of one of its walls 4*a*, 4*b* with a hook-like extension 7 lying in the same plane as the wall and defined by a short upwardly directed slot 7*a*. The walls 3*a*, 3*b* of runner 3 are provided with downwardly extending slots 8, so positioned and spaced as to coincide with the extensions 7 and having a length such as to ensure that in the assembled ceiling the bases of the runners and louvers will be co-planar.

Each slot 8 is formed so that it is much wider at the top than at the bottom by making one edge 8*a* vertical and the other edge 8*b* sloping downwardly toward the bottom of the vertical edge. Consequently the hook-like extension 7 of the louver member being inserted from above will slide easily into the slot 8 and down the sloping or tapered side 8*b* into place.

Figure 3:
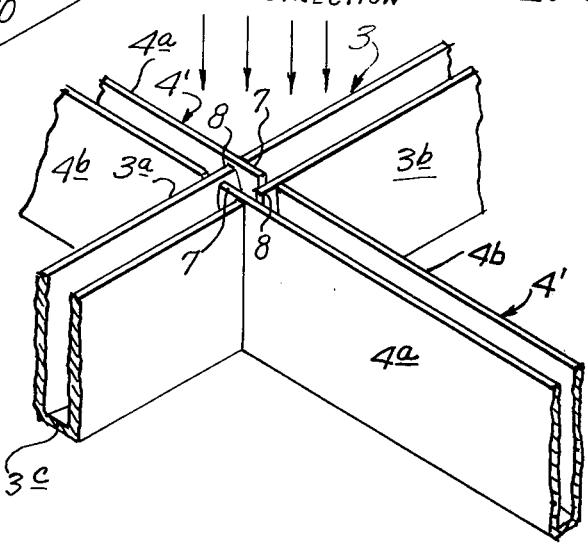
FIG. 3 is a fragmentary perspective view showing parts of louver panels attached to a hanger on opposite sides thereof.
Figure 4:
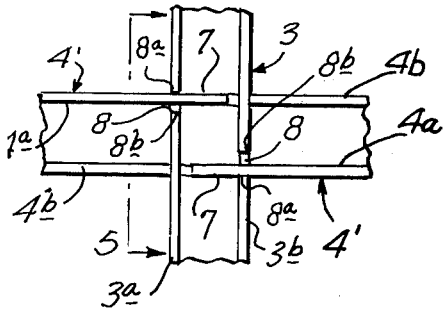
FIG. 4 is a top plan view of the portions shown in FIG. 3.
Figure 5:
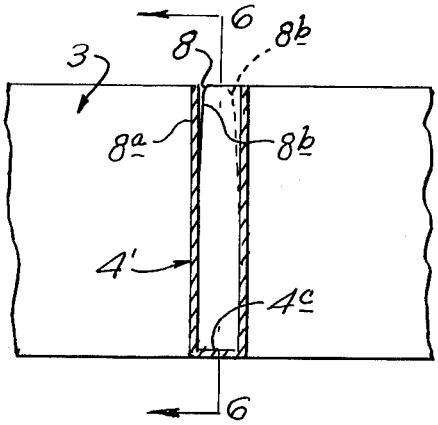
FIG. 5 is a sectional view taken on line 5—5 of FIG. 4 and looking in the direction of the arrows.
Figure 6:
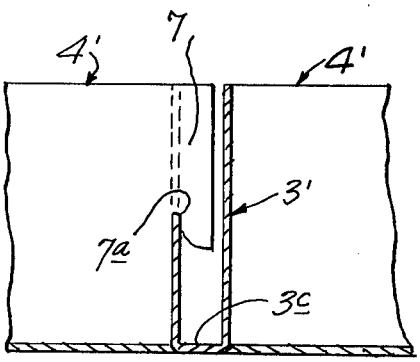
FIG. 6 is a sectional view taken on line 6—6 of FIG. 5 and looking in the direction of the arrows.

This tapering of one side of the slot means that the ceiling louver panels 1, 2, etc., being installed on a job site can be located in their hanger runners much more accurately and quickly than if the sides of the slots were narrow and parallel. Normally such widening of slots would result in a "leaking" of light in a louvered luminous ceiling, i.e., instead of the light from above being reflected, from the panel sides it would pass directly through the gap between the sides of the intersecting louver members and the edges of the widened slots in the runners and cause bright spots of light which would detract from the overall uniformity of indirect lighting which the luminous ceiling system seeks to achieve. Such "light leaks" are eliminated by the unique, offset arrangement of the tapered slots 8 which as best seen in FIGS. 3 and 4, places the tapered side 8b of each slot within the U-shaped channels of the runner 3 and the engaged louver members 4'. Thus the light from above, which passes through the gaps which occur between the tapered slot walls 8*b* and the hook-shaped extensions 7 inserted in slots 8, is trapped in the U channels, and does not pass through the bottom walls 3*c*, 4*c*, 5*c* to cause a "light leak." The opposed wall 8*a* of each slot, being vertical, abuts the adjacent side of the engaged louver member 4' and, therefore, does not leak light.

FIGS. 3 and 4 demonstrate how the projecting panel members are made so that one wall 4*a* has the extension 7 which projects into the hanger runner 3 at a tapered slot 8, while the opposed wall 4*b* is made to butt flush against the hanger runner side 3*a*. The other panel member 4 engages the opposed wall of runner 3 so that after 3 wall 4*a* enters the hanger runner at wall 3*b* and projects into a tapered slot 8 directly opposite wall 4*b* of the first panel, while its other wall, 4*a*, butts flush against wall 3*b* of the hanger runner.

Figure 2:
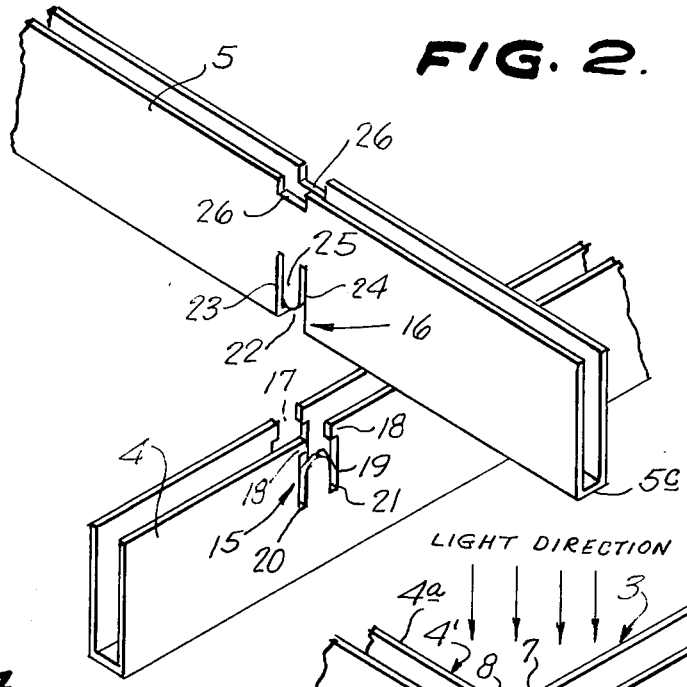
FIG. 2 is an exploded fragmentary perspective view showing the manner of attaching the louver members together.

Referring to FIG. 2, it will be seen that the intersecting members 4, 5 of the louvers or panels need not be permanently attached to each other, but may be shipped out by the manufacturer in a separated state, for economy of volume, and the louvers may then be assembled on site. Thus, each member 4 may have a slot arrangement 15 in each wall thereof at each location where it is adapted to be crossed by a member 5 and each member 5 will have a cooperating slot arrangement 16 at each location where it is adapted to be crossed by a member 4. The slot arrangement 15 includes a downwardly extending slot portion 17, defined by inwardly extending tabs 18, an inverted U-shaped slot portion 19, below slot portion 17 and two vertically elongated slot protions 20 and 21 below slot portion 19. The slot arrangement 16 includes a slot portion 22, extending across the base 5*c*, and two upwardly extending elongated slot portions 23 and 24 on either side of a wall portion 25 which has a U-shaped lower edge spaced above base 5*c*. The upper edge of each wall of member 5 has short, downwardly extending slots 26, 26 which are aligned with slot portions 23, 24 and it will be manifest that when the two members 4 and 5 are interengaged the ends of slot portions 23, 24 will abut the ends of slot portions 20, 21 and the tabs 18 will be located in slots 26, 26 to secure and lock the members together.

The runners 3, being of channel section, need not be of high-temper material, but may be of the same type of material as is used for the louvers 4, 5 and may be subjected, therefore, to the same pre-painting treatment as the louvers and simultaneously therewith. This ensures a perfect match of the louvers and runners and augments the impression that the assembled ceiling is in the form of one large louver. The dimensions of the members 4 and 5 and the runners 3 will be the same, of course, apart from length.

The use of channel section members and runners enables the use of larger cells with light gauge materials, such larger cells otherwise requiring heavy gauge slats, which are, of course, more expensive and heavier.

The greater strength afforded by the channel section will allow the suspension from the louvered ceiling of heavier than normal mobiles, signs or the like.

It will be appreciated that changes may be made in the embodiment described. For example, the upper edges of the opposing walls of the runners and/or the louver members could be turned in toward each other to provide a box section as opposed to a channel section. This could prove useful for housing electrical wiring or the like. Moreover, the louver members extending in one direction may project below the members running at right engles thereto to give a different visual effect. Also, the walls of the runners and louver members could be perforated and sound absorbing material could be inserted in the runners and members.

The louver panels disclosed herein may be used with continuous hanger runners, as described, or may be used as part of a ceiling which has some panels fixed and some removable. In the latter case, the invention gives an improved, i.e. less visible, joint between the panels.

Although a certain specific embodiment of the invention has been shown and described, it is obvious that many modifications thereof are possible. The invention, therefore, is not intended to be restricted to the exact showing of the drawings and description thereof, but is considered to include reasonable and obvious equivalents.

What is claimed is:

1. A light transmitting, louvered ceiling assembly comprising:

a. at least one runner of upwardly open channel section, comprising a first side-wall, a second side-wall and a base wall joining said side-walls;

b. a louver comprising first and second sections, adapted to be supported on said runner, each of said first and second sections comprising at least one upwardly open channel member having a third side-wall, a fourth side-wall and a base wall joining said side-walls;

c. a downwardly extending slot disposed in each of said first and second side-walls of said runner, each of said slots having widened upper portion, a narrowed lower portion and a substantially vertical edge, the vertical edges of the slots in said first and second side-walls being offset from each other by a distance substantially equal to the spacing between said third and fourth side-walls;

d. each of said third side-walls comprising a downwardly extending hook-shaped extension, the extension from said first louver section being engaged in the slot in said runner first side-wall and the extension from said second louver section being engaged in the slot in said runner second side-wall, said extensions projecting within said runner channel, said third side-walls abutting against said vertical edges of said slots in proximity to said extensions, the fourth side-wall of said first louver section terminating in a substantially vertical edge which abuts against said runner first side-wall and the fourth side-wall of said second louver section terminating in a substantially vertical edge which abuts against said runner second side-wall, so as to prevent light leakage through said widened slot portions.

2. The assembly set forth in claim 1 wherein said runners and louver members are steel extrusions, the exterior surfaces of the runners and louver members being painted the same color.

3. An assembly as claimed in claim 1, wherein said runners and louver members are aluminum alloy extrusions, the exterior surfaces of the runners and louver members being painted the same color.

4. An assembly as claimed in claim 1, wherein each of said slots has a vertical edge and an opposed edge sloping toward the bottom of said vertical edge.

5. An assembly as claimed in claim 1, wherein the channel heights of the louver members and runners are equal so that upon assembly of the louvers with the runners the base walls of said members and runners lie in the same plane.

6. The assembly set forth in claim 1 wherein each of said louver sections is formed of intersecting channel members, forming a grid of open cells between the members for transmission of light and air.

7. An assembly as claimed in claim 6, wherein said members have cooperating slot arrangements therein whereby the louver may be assembled on site by snapping said members together.

* * * * *

REEXAMINATION CERTIFICATE (787th)

United States Patent [19]

Taylor

[11] B1 4,034,534

[45] Certificate Issued Dec. 8, 1987

[54] LOUVERED CEILING

[75] Inventor: John L. Taylor, Jagerslaan, Netherlands

[73] Assignee: Intalite International, Willemstaad, Netherlands Antilles

Reexamination Request:
No. 90/001,130, Nov. 21, 1986

Reexamination Certificate for:

| | |
|---|---|
| Patent No.: | **4,034,534** |
| Issued: | **Jul. 12, 1977** |
| Appl. No.: | **649,724** |
| Filed: | **Jan. 16, 1976** |

Related U.S. Application Data

[63] Continuation-in-part of Ser. No. 462,423, Apr. 19, 1974, abandoned.

[30] Foreign Application Priority Data

Apr. 30, 1973 [CA] Canada ..... 169893

[51] Int. Cl.[4] ..... E04C 2/47
[52] U.S. Cl. ..... 52/668; 403/347
[58] Field of Search ..... 52/667, 668, 664; 362/325, 342, 354

[56] References Cited

U.S. PATENT DOCUMENTS 2,905,286 9/1959 Adams et al. ..... 52/667
3,378,980 4/1968 Blitzer, Jr. ..... 52/668

*Primary Examiner*—Alfred C. Perham

[57] ABSTRACT

A light transmitting false ceiling made up of louvers and supporting runners, the latter being adapted to be suspended from a normal ceiling with lamps mounted above the false ceiling. The louvers have extensions at opposite edges for engagement with and support by the adjacent runners. The louvers are made up of intersecting members defining open cells therebetween. Each of the louver members as well as each of the runners is of upwardly open channel section. The runners have downwardly extending slots in their upstanding walls to receive hook-shaped extensions on the louver members, and these slots are wider at the top than at the bottom to facilitate installation on site. The widened runner slots on one wall of each runner are offset from those on the opposed wall by the width of the louver channel members. The hooked-shaped extensions on the members protrude into the channels of the runners and together with the bottom and upstanding walls of the runners block light leaks through the widened runner slots so that light is transmitted uniformly through the false ceiling to yield the appearance of a single large louver with no apparent seams.

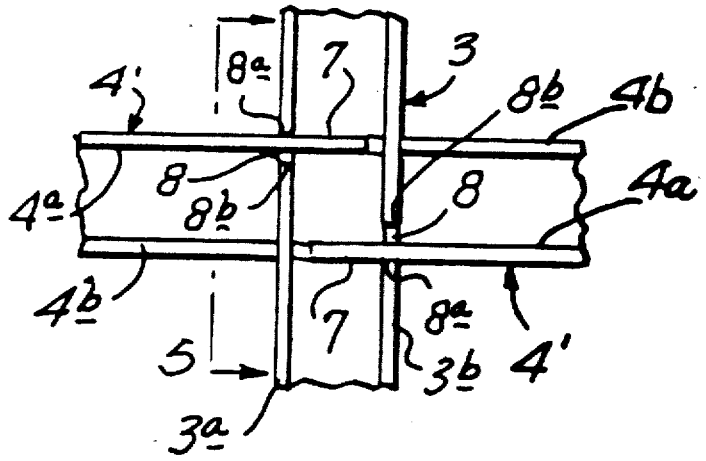

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *